United States Patent [19]

Smith

[11] Patent Number: 4,459,515

[45] Date of Patent: Jul. 10, 1984

[54] PHASE-CONTROLLED BALLAST HAVING SHIFTING CONTROL

[75] Inventor: Alan M. Smith, Hendersonville, N.C.

[73] Assignee: General Electric Company, Schenectady, N.Y.

[21] Appl. No.: 342,979

[22] Filed: Jan. 26, 1982

[51] Int. Cl.[3] ..... G05F 1/00; H05B 37/02; H05B 39/04; H05B 41/36

[52] U.S. Cl. ..... 315/194; 315/195

[58] Field of Search ..... 315/194, 195, 199, 307, 315/308, 301

[56] References Cited

U.S. PATENT DOCUMENTS 3,344,311 9/1967 Nuckolls ..... 315/199
3,500,124 3/1970 Babcock ..... 315/200

*Primary Examiner*—David K. Moore
*Assistant Examiner*—Robert E. Wise
*Attorney, Agent, or Firm*—Ernest W. Legree; Philip L. Schlamp; Fred Jacob

[57] ABSTRACT

This invention relates to a circuit for shifting a control signal from governance by one variable function to governance by another. It is more particularly concerned with a phase-controlled ballast wherein such a circuit shifts the control from a function of lamp current to a function of line voltage for better overall performance and economy.

2 Claims, 4 Drawing Figures

PHASE-CONTROLLED BALLAST HAVING SHIFTING CONTROL

BACKGROUND OF THE INVENTION

Phase-controlled circuits are known which use electronic switches such as silicon controlled rectifiers (SCR's) or bilateral switches such as triacs, for automatically starting, regulating and stopping the operation of load devices such as discharge lamps. They are particularly favored for the regulation of high intensity discharge lamps such as metal halide and high pressure sodium lamps. Such circuits are described in U.S. Pat. Nos. 3,344,310-Nuckolls, Universal Lamp Control Circuit With High Voltage Producing Means and 3,500,124-Babcock, Discharge Lamp Control Circuit with Semiconductor Actuating Means Therefor.

SUMMARY OF THE INVENTION

The object of the invention is to provide a circuit suitable for use with a phase-controlled ballast which permits the control or governance of the load device to be shifted from one variable function to another. By so doing, it is possible to obtain a phase-controlled ballast possessing both low start current characteristic and a volt-watt curve suitable for the operation of high intensity discharge (HID) lamps and in particular high pressure sodium and metal halide lamps.

In accordance with my invention the control circuit receives a first reference signal which by way of example is an increasing function of lamp current. It receives a second reference signal which by way of example is an increasing function of line voltage. These reference signals are supplied to diode gate means which function to pass only the greater signal to a control means. The control means in turn is linked to an electronic switch and operates to vary the firing angle thereof according to the signal and thereby control the load current, such as the current to the lamp.

DETAILED DESCRIPTION

Figure 1:
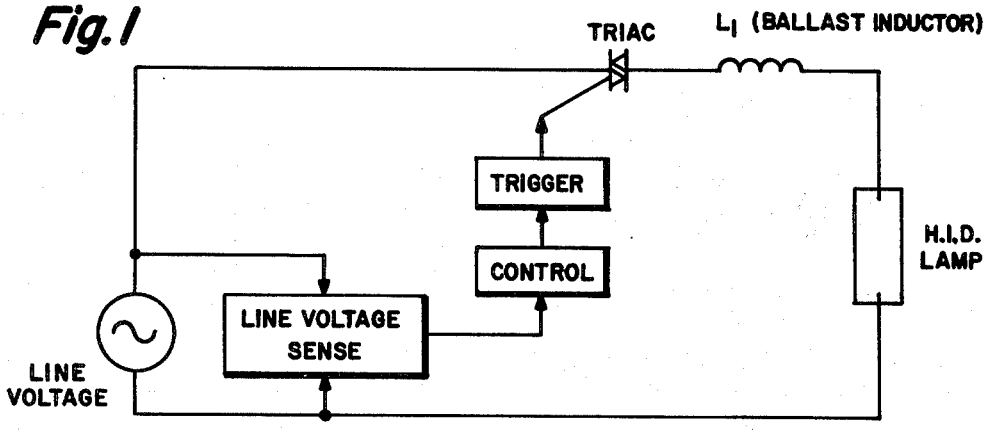
FIG. 1 shows in block form a typical line voltage regulation phase control ballast.

In the typical line voltage regulation phase-controlled ballast represented in FIG. 1, a signal proportional to lamp voltage is developed in the line voltage sense circuit. The output of this circuit is in turn used to drive a control circuit. The control circuit responds by delaying its output to the trigger circuit according to increase in the line voltage sense signal.

When line voltage increases, the line voltage sense circuit output signal also increases. This causes an additional delay in the triggering of the triac during each half cycle of the line voltage; thus, power to the HID lamp is not allowed to rise in its normal characteristic manner. If line voltage decreases, the line voltage sense circuit output signal also decreases causing a subsequent advancement in the triggering of the triac during each half cycle of the line voltage; thus power to the HID lamp is not allowed to drop in its normal characteristic manner.

An advantage of this circuit is the so-called "rainbow curve" characteristic, well known to ballast designers. Its volt-watt curve resembles the characteristically parabolic power transfer curve exhibited by all reactor ballasts and which, when volts are plotted as abcissa and watts as ordinate, has somewhat the appearance of a rainbow. The rainbow curve characteristic allows for the operation of high pressure mercury, metal halide, and high pressure sodium lamps without wide variations in lamp power over the operating voltage range of these lamps.

The disadvantage of this circuit stems from its high lamp starting current. Since the circuit only corrects for line voltage fluctuations and not lamp voltage changes, its starting current is substantially higher than run current (after the lamp has warmed up). The high start current may reduce substantially the number of ballasts a particular circuit can maintain—an important economic consideration.

Figure 2:
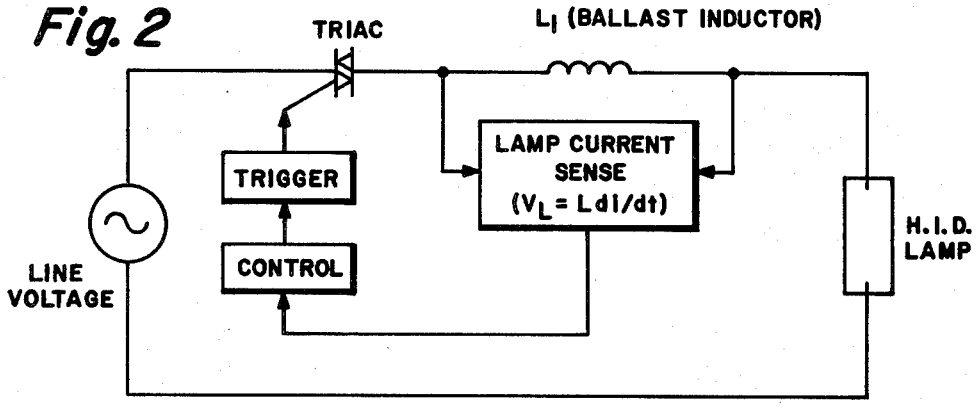
FIG. 2 shows in block form a typical lamp current stabilizing phase control ballast.

In the typical lamp current stabilizing ballast represented in FIG. 2, operation is similar to that in the previously described approach except that the reference signal now is derived from the voltage across the ballast inductor and is proportional to lamp current. Immediately after the HID lamp is started, the lamp voltage is low but lamp current is high; thus the lamp current sense circuit output signal (ballast inductor voltage $V_L = L\ di/dt$) is high. This causes the firing of the triac to be greatly delayed at each half cycle. In this way, the high start current experienced in the previous circuit cannot appear in this circuit because at lamp start, firing of the triac is greatly delayed. As the lamp voltage increases, the lamp current sense circuit output signal decreases, allowing the triac to fire earlier at each half cycle and tending to hold lamp current constant. If line voltage increases, the voltage across the ballast inductor will increase causing the triac's firing to be delayed. If line voltage decreases, the voltage across the ballast inductor will be decreased, causing the triac's firing to be advanced. In this way the circuit will still maintain a constant current to the lamp.

The disadvantage of this circuit approach is that it cannot operate well with excess amalgam lamps like high pressure sodium lamps and that for a relatively narrow range of lamp voltages, a wide variation in lamp wattage may result.

Figure 3:
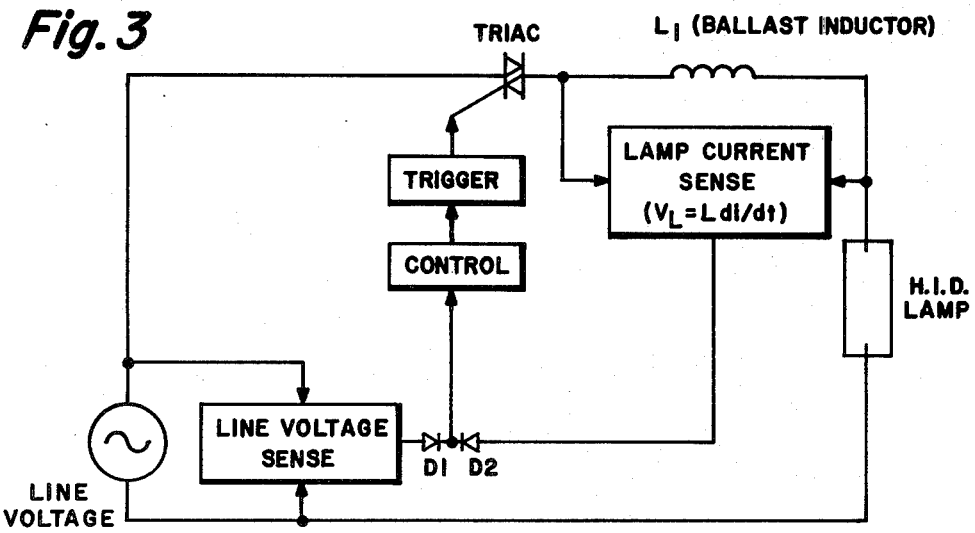
FIG. 3 shows in block form a control circuit allowing the shift of governance in accordance with the invention.

A phase-controlled ballast embodying the invention and featuring the combination of low start current and rainbow curve run characteristic is represented in block form in FIG. 3. Operation of this circuit is the same as the FIG. 2 circuit for low lamp voltages. At a certain lamp voltage, the circuit ceases to operate as in FIG. 2 and begins to operate as in FIG. 1. This results in a low start current ballast with a "rainbow curve" ballast characteristic in the lamp operating voltage range.

Figure 4:
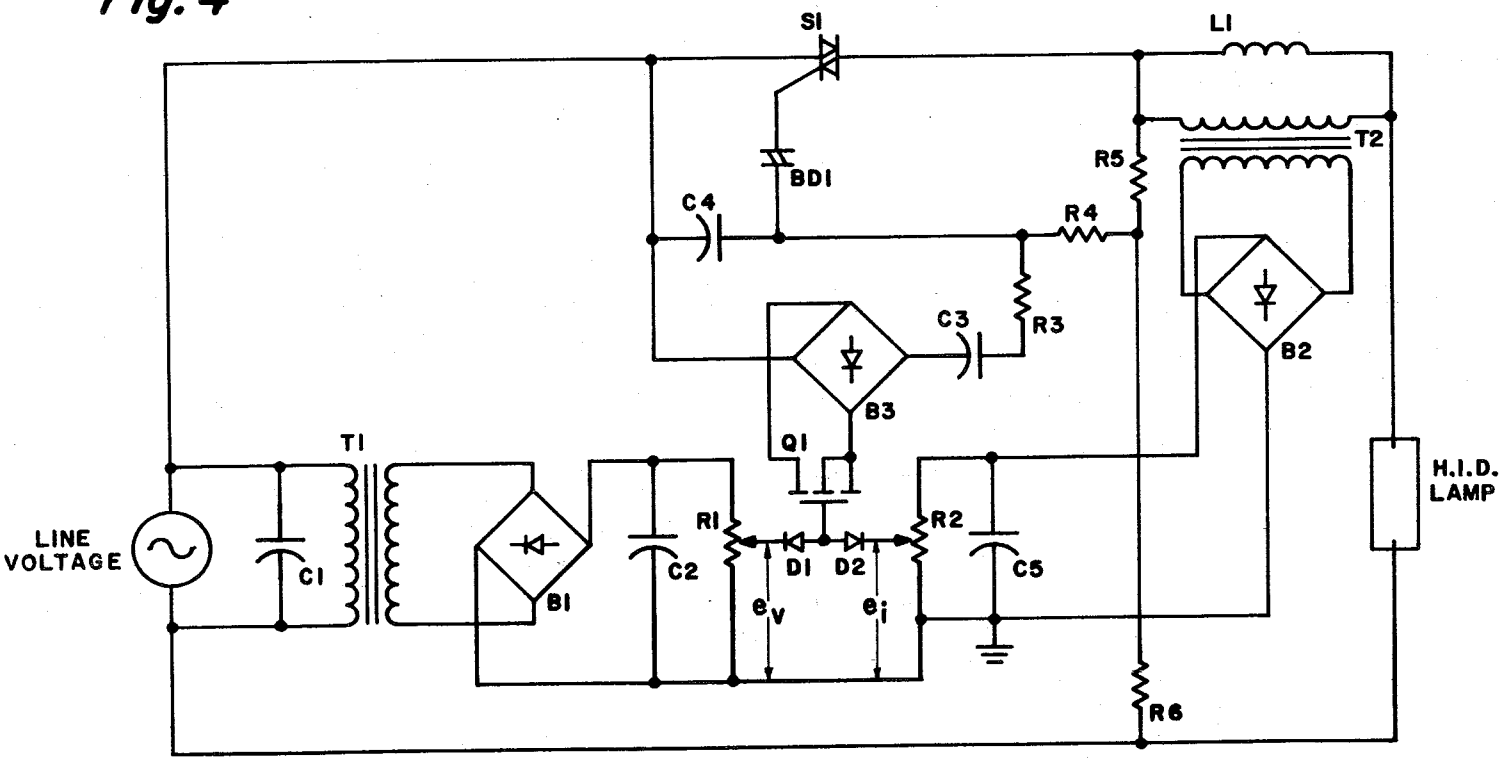
FIG. 4 is a circuit diagram of a control circuit embodying the invention combined with a phase control ballast for a discharge lamp.

The detailed application of the invention in a practical circuit is shown in FIG. 4. The triac S1, inductor L1, the HID lamp and the line voltage comprise the main power loop of the circuit. At each half cycle of the line voltage, capacitor C4 is charged through resistors R6, R5, and R4 until the breakdown voltage of silicon bilateral switch BD1 is reached. At this time C4 discharges into the gate of the triac S1 turning it on.

Bridge B3, capacitor C3, transistor Q1, and resistor R3 comprise a shunt path for charge current around capacitor C4. When the channel resistance of transistor Q1 is thus reduced, some of the current available for the charging of C4 is diverted, resulting in a necessarily longer time for the voltage across C4 to reach the break-down voltage of switch BD1, delaying the firing of the triac S1. Transformer T1, bridge B1, capacitor C2, and resistor R1 make up the line voltage sense circuit of FIG. 3. Transformer T2, bridge B2, capacitor C5 and resistor R2 make up the lamp current sense of FIG. 3. Also must be noted the gating diodes D1 and D2.

Operation is the same as described with reference to the FIG. 3 block diagram. The shift in control or governance through gating diodes D1 and D2 is the heart of the invention—which can be used with many different phase-controlled ballast types. The lamp voltage is low at start (as described earlier), resulting in a high ballast reactor voltage at that time; however, at this same time the line voltage reference can be scaled to be at a level below the L di/dt reference level. If now these two references are gated by diodes to a common point, the L di/dt reference will be the sole determiner of triac pulse angle at this time. As the lamp voltage increases, the ballast reactor voltage decreases; therefore the magnitude of the L di/dt reference decreases. If the two references are set properly, then at a point below the normal operating range of the HID lamp (below the lowest possible operating lamp voltage which would be expected to occur), the line voltage reference would be higher than the L di/dt reference and the line voltage reference would become the sole determiner of triac phase angle from then on. This now would result in a "rainbow" ballast characteristic curve. When lamp voltage is low at starting, the output $e_i$ is applied to the gate of transistor Q1. When lamp voltage reaches a certain threshold, the output $e_v$ is applied to transistor Q1. Since the transistor Q1 channel resistance will decrease with increasing voltage at its gate terminal, an increase in the transistor gate voltage will tend to increase the firing angle of the triac, decreasing the power applied to the lamp.

What I claim as new and desire to secure by Letters Patent of the United States is:

1. A phase-controlled load current regulating circuit comprising:

an electronic switch and a reactance connected in series with a load across an alternating current voltage source, said switch operating to regulate current through the load by varying its firing angle, means for generating a first reference signal whose amplitude is a function of load current, means for generating a second reference signal whose amplitude is a function of line voltage, diode gate means for each of said signals functioning to transmit predominantly the signal of greater amplitude to a control means, said control means being linked to said switch and operating to increase the firing angle thereof in accordance with the amplitude of the transmitted signal, whereby governance of firing angle shifts to the reference signal of greater amplitude.

2. A phase-controlled ballast comprising:

a triac and an inductance adapted to be connected in series with a discharge lamp across an alternating current voltage source, said triac serving to limit current through the lamp by increasing its firing angle, means for generating a first reference signal whose amplitude increases with lamp current, means for generating a second reference signal whose amplitude increases with line voltage, diode gate means for each of said signals functioning to transmit predominantly the signal of greater amplitude to a control means, said control means being linked to said triac and operating to increase the firing angle thereof when the amplitude of the transmitted signal increases, whereby governance of firing angle shifts to the reference signal of greater amplitude.

* * * * *